US012752882B2

(12) United States Patent
Wang

(10) Patent No.: US 12,752,882 B2
(45) Date of Patent: Oct. 6, 2026

(54) AIR COUCH BED

(71) Applicant: Team Worldwide Corporation, Taipei City (TW)

(72) Inventor: Cheng-Chung Wang, Taipei City (TW)

(73) Assignee: TEAM WORLDWIDE CORPORATION, Taipei City (TW)

( * ) Notice: Subject to any disclaimer, the term of this patent is extended or adjusted under 35 U.S.C. 154(b) by 2 days.

(21) Appl. No.: 18/739,476

(22) Filed: Jun. 11, 2024

(65) Prior Publication Data

US 2024/0407558 A1 Dec. 12, 2024

Related U.S. Application Data

(60) Provisional application No. 63/472,531, filed on Jun. 12, 2023.

(51) Int. Cl.

| | |
|---|---|
| ***B63B 7/08*** | (2020.01) |
| ***A47B 37/00*** | (2006.01) |
| ***A47C 1/024*** | (2006.01) |
| ***A47C 1/026*** | (2006.01) |
| ***A47C 4/54*** | (2006.01) |
| ***A47C 7/54*** | (2006.01) |
| ***A47C 15/00*** | (2006.01) |
| ***A47C 17/04*** | (2006.01) |
| ***A47C 17/16*** | (2006.01) |
| ***A47C 21/02*** | (2006.01) |
| ***A47C 27/08*** | (2006.01) |
| ***B63B 34/00*** | (2020.01) |

(52) U.S. Cl.

CPC ..... *B63B 7/08* (2013.01); *A47B 37/00* (2013.01); *A47C 1/0248* (2013.01); *A47C 1/026* (2013.01); *A47C 4/54* (2013.01); *A47C 7/54* (2013.01); *A47C 15/006* (2013.01); *A47C 17/045* (2013.01); *A47C 17/16* (2013.01); *A47C 21/022* (2013.01); *A47C 27/081* (2013.01); *B63B 34/00* (2020.02)

(58) Field of Classification Search

CPC ..... B63B 7/08; B63B 34/00; B63B 34/50; B63B 34/565; A47B 37/00; A47C 1/0248; A47C 1/026; A47C 4/54; A47C 7/54; A47C 15/006; A47C 17/045; A47C 17/16; A47C 21/022; A47C 27/081

USPC ..... 5/37.1; 441/130

See application file for complete search history.

(56) References Cited

U.S. PATENT DOCUMENTS 2,623,574 A * 12/1952 Wilhelm ..... A47C 1/146 5/705
2007/0061977 A1* 3/2007 Zheng ..... A47C 4/54 5/655.3
2007/0169273 A1* 7/2007 Wu ..... A47C 17/045 5/710

(Continued)

*Primary Examiner* — Justin C Mikowski
*Assistant Examiner* — George Samuel Gines
(74) *Attorney, Agent, or Firm* — McClure, Qualey & Rodack, LLP

(57) ABSTRACT

An air couch bed includes a first inflatable body. The first inflatable body includes a first wall, a second wall disposed opposite to the first wall, and a third wall connecting the first wall and the second wall. The second wall defines a concave space, by virtue of which the first inflatable body is bendable. The concave space is extended to the third wall. The first inflatable body is an air bed when the first inflatable body is flattened, and is an air couch when the first inflatable body is bent.

14 Claims, 3 Drawing Sheets

(56) References Cited

U.S. PATENT DOCUMENTS

| | | | | |
|---|---|---|---|---|
| 2011/0107520 | A1* | 5/2011 | Neggers | A47C 20/048 5/722 |
| 2011/0265267 | A1* | 11/2011 | Wang | A47C 20/047 5/722 |

* cited by examiner

AIR COUCH BED

CROSS REFERENCE TO RELATED APPLICATIONS

This application claims the benefit of U.S. Provisional Application No. 63/472,531, filed Jun. 12, 2023, which is incorporated by reference herein in its entirety.

BACKGROUND OF THE INVENTION

Field of the Invention

The invention relates to an air couch bed with simple structure and easy operation.

Description of the Related Art

Couch beds are multifunctional furniture that can function as beds when unfolded and couches when upright, for users to better use spaces.

BRIEF SUMMARY OF THE INVENTION

The invention provides an air couch bed which is simple in structure and easy in operation. The air couch bed in accordance with an exemplary embodiment of the invention includes a first inflatable body. The first inflatable body includes a first wall, a second wall disposed opposite to the first wall, and a third wall connecting the first wall and the second wall. The second wall defines a concave space, by virtue of which the first inflatable body is bendable. The concave space is extended to the third wall. The first inflatable body is an air bed when the first inflatable body is flattened, and is an air couch when the first inflatable body is bent.

In another exemplary embodiment, the second wall comprises an arch-like portion which defines the concave space.

In yet another exemplary embodiment, the air couch bed further includes a tensioning element connected to the second wall of the first inflatable body and extended over the concave space.

In another exemplary embodiment, the air couch bed further includes a second inflatable body disposed in the concave space wherein the first inflatable body is pushed to be bent by the second inflatable body when the second inflatable body is inflated.

In yet another exemplary embodiment, the air couch bed further includes a tensioning element connected to the second wall of the first inflatable body and extended over the concave space.

In another exemplary embodiment, the air couch bed further includes a tensioning element connected to the second wall of the first inflatable body. The tensioning element is in tension when the second inflatable body is inflated to bend the first inflatable body. The first inflatable body is flattened by the tensioning element when the second inflatable body is deflated.

In yet another exemplary embodiment, the tensioning element is an elastic cord.

In another exemplary embodiment, the air couch bed further includes a tensioning element connected to the first inflatable body so as to keep the first inflatable body bent.

In yet another exemplary embodiment, the tensioning element is connected to the third wall.

In another exemplary embodiment, the tensioning element is a buckle strap.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
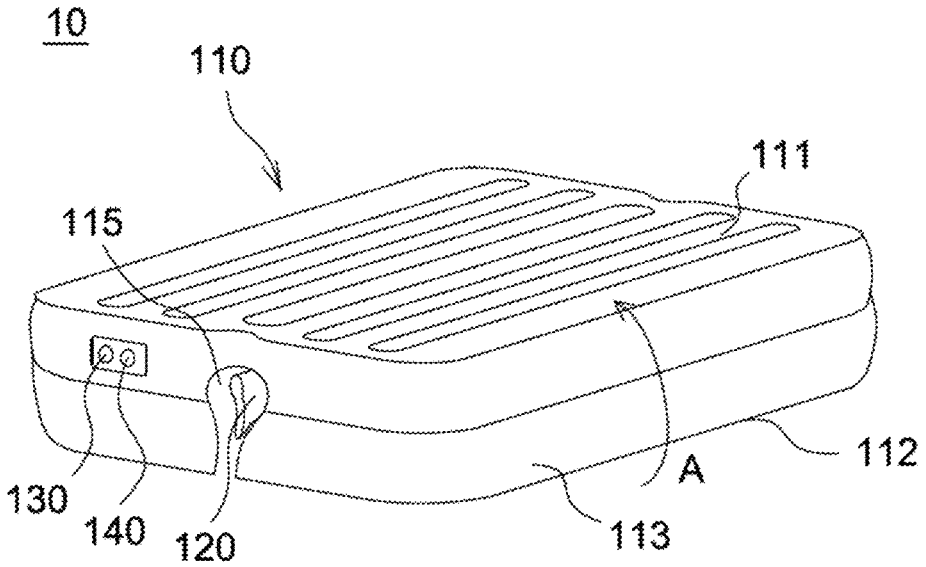
FIG. 1 is a perspective view of an air couch bed in a flattened state in accordance with a first embodiment of the invention, showing the top of the air couch bed disposed upward.
Figure 2:
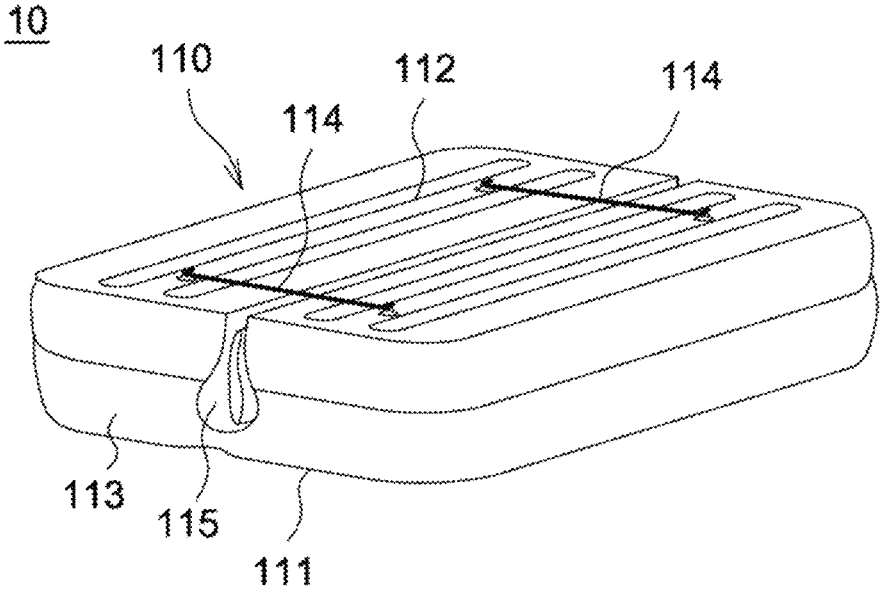
FIG. 2 is another perspective view of the air couch bed in a flattened state in accordance with the first embodiment of the invention, showing the bottom of the air couch bed disposed upward.

Referring to FIGS. 1 and 2, an air couch bed 10 in accordance with a first embodiment of the invention includes an inflatable body 110. The inflatable body 110 includes a first wall 111, a second wall 112 disposed opposite to the first wall 111, and a third wall 113 connecting the first wall 111 and the second wall 112.

The second wall 112 defines a concave space 115. Specifically, the second wall 112 has a portion that is concaved to form the concave space 115. The concave space 115 is oriented lengthwise and extended to the third wall 113. In the first embodiment, the portion is an arch-like portion that defines the concave space 115.

As shown, the air couch bed 10 further includes at least one tensioning element 114 connected to the second wall 112. In the first embodiment, the tensioning element 114 is an elastic cord. The elastic cord is extended over the concave space 115.

The air couch bed 10 further includes another inflatable body 120 disposed in the concave space 115.

In the first embodiment, the air couch bed 10 is an electric couch bed. When a switch 130 is turned on, the inflatable body 110 is inflated. When another switch 140 is turned on, the inflatable body 120 disposed in the concave space 115 is inflated. An air pump (not shown) is connected to the inflatable bodies 110, 120 through manifold (not shown) or different tubes (not shown). Therefore, the inflatable bodies 110, 120 can be individually inflated. The art of air pump and tube(s) is well known and therefore the detailed descriptions thereof are omitted.

Figure 3:
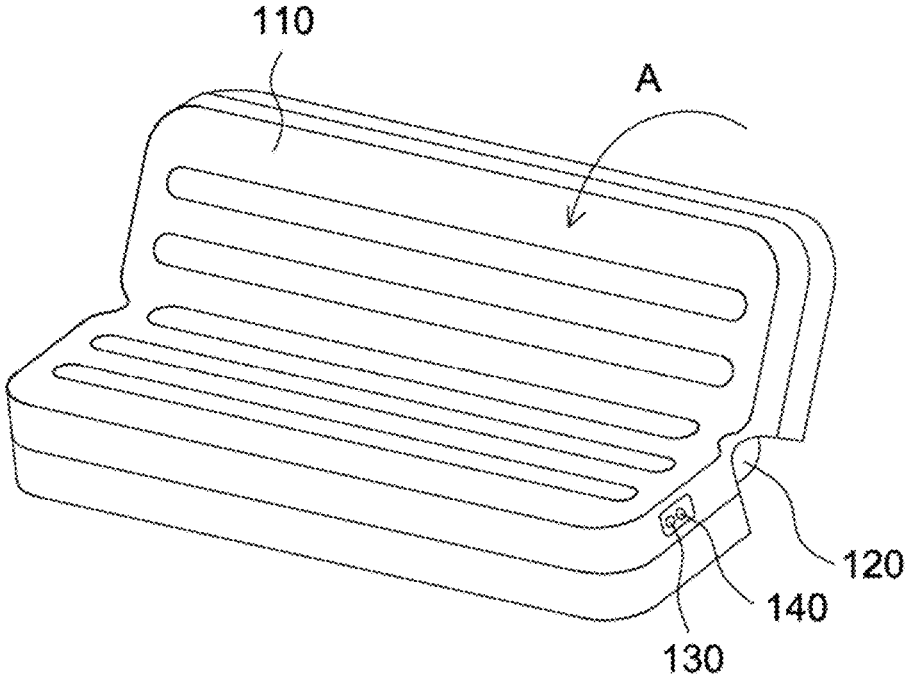
FIG. 3 is a perspective view of the air couch bed in an upright state in accordance with the first embodiment of the invention, showing the front of the air couch bed.
Figure 4:
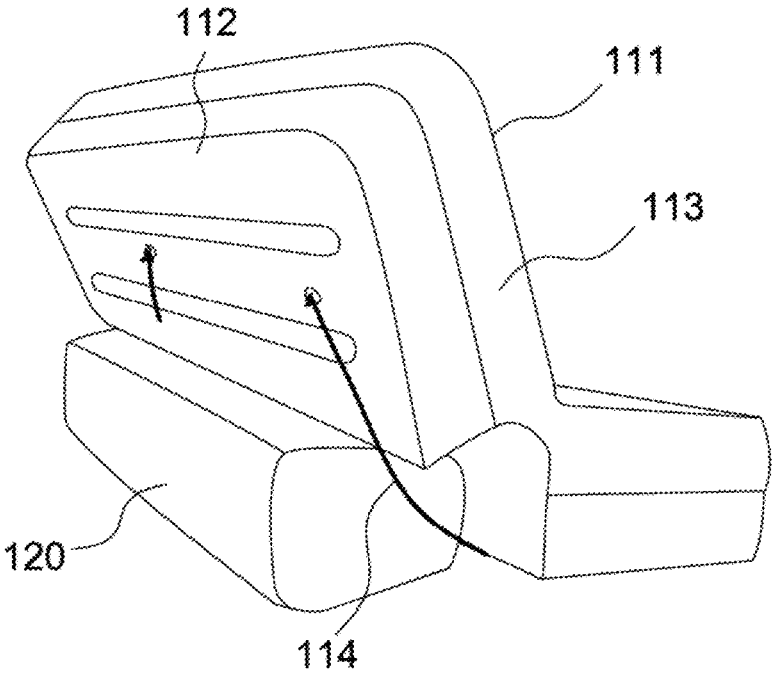
FIG. 4 is another perspective view of the air couch bed in an upright state in accordance with the first embodiment of the invention, showing the back of the air couch bed.

In operation, the inflatable body 110 is inflated to expand as shown in FIG. 1, wherein the inflatable body 110 is in a flattened state and the air couch bed 10 can be used as an air bed. As described, the inflatable body 110 has a concave space 115 formed on the second wall 112. Such structure is provided so that the inflatable body 110 can be bent in the direction A. In operation, the inflatable body 120 contained in the concave space 115 is inflated to expand, the inflatable body 110 is pushed to be bent by the expanded inflatable body 120, and the tensioning element 114 is stretched (in tension) as shown in FIGS. 3 and 4. By the operation, the air couch bed 10 is converted to an air couch.

It is worth noting that the inflatable body 120 is provided not only for bending the inflatable body 110 but for keeping the inflatable boy 110 upright or inclined. The inclined angle of the inflatable body 110 is determined by the extent of expansion of the inflatable body 120.

To convert the air couch bed 10 back to an air bed, the inflatable body 120 is deflated so that the inflatable body 110 can restore to the flattened state by a restoring force of the tensioning element 114.

From the above descriptions, it is understood that the air couch bed 10 is simple in structure and easy in operation.

Figure 5:
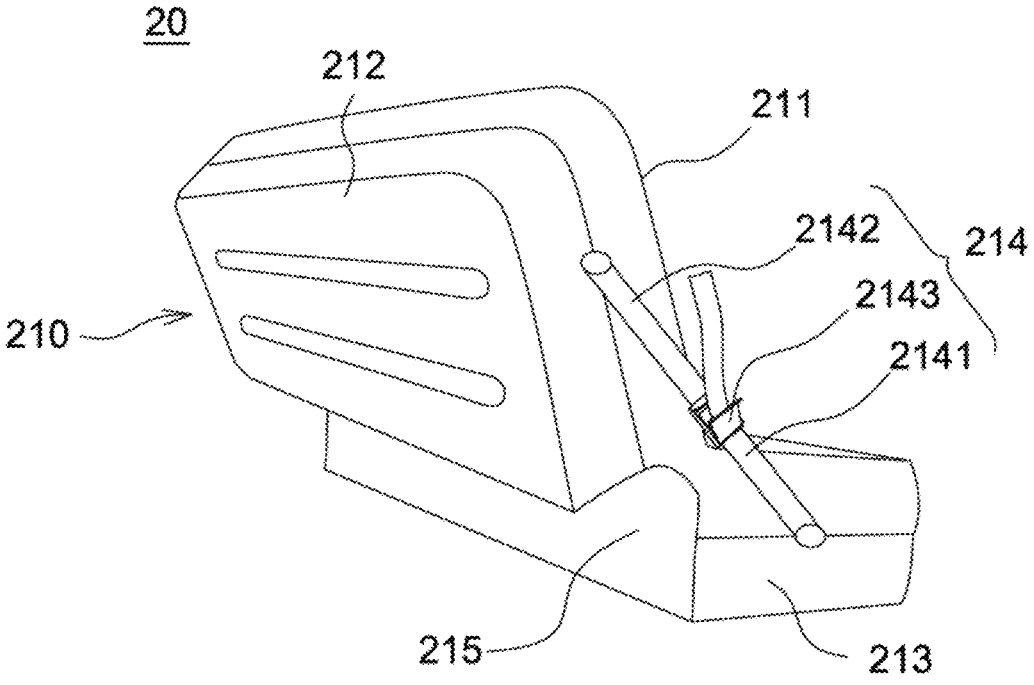
FIG. 5 is a perspective view of an air couch bed in an upright state in accordance with a second embodiment of the invention, showing the back of the air couch bed.

Referring to FIG. 5, an air couch bed 20 in accordance with a second embodiment of the invention includes an inflatable body 210. The inflatable body 210 includes a first wall 211, a second wall 212 and a third wall 213 connecting the first wall 211 and the second wall 212.

The second wall 212 defines a concave space 215. The concave space 215 of the second embodiment is identical or similar to that of the first embodiment.

The air couch bed 20 further includes at least one tensioning element 214. In the second embodiment, the tensioning element 214 is a buckle strap. The buckle strap 214 includes two parts 2141, 2142 connected to the third wall 213, and a buckle 2143 for connecting or disconnecting the two parts 2141, 2142.

It is worth noting that the air couch bed 20 of the second embodiment does not have the inflatable body 120 of the first embodiment.

In the second embodiment, the air couch bed 20 is a manual couch bed. In operation, the inflatable body 210 is inflated to expand. The air couch bed 20 can be used as an air bed when the inflatable body 210 is in a flattened state. To convert the air couch bed 20 to an air couch, the user can manually bend the inflatable body 210 thanks to the concave space 215, and connect the parts 2141, 2142 of the buckle strap 214 by using the buckle 2143 to keep the air couch bed 20 upright or inclined. The length of the part 2141 or 2142 is adjustable so as to change the inclined angle of the air couch.

To convert the air couch bed 20 back to an air bed, the user can manually disconnect the parts 2141, 2142 of the buckle strap 214. Then, the inflatable body 210 can automatically restore to the flattened state.

From the above descriptions, it is understood that the air couch bed 20 is also simple in structure and easy in operation.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An air couch bed, comprising:

a first inflatable body comprising a first wall, a second wall disposed opposite to the first wall, and a third wall connecting the first wall and the second wall;

wherein the second wall defines a concave space, the concave space being oriented lengthwise and extended to the third wall, by virtue of which the first inflatable body is bendable;

wherein the first inflatable body is an air bed when the first inflatable body is flattened, and is an air couch when the first inflatable body is bent;

wherein the air couch bed further comprises a tensioning element connected to the first inflatable body and extending over the concave space;

wherein the tensioning element is configured to bias the first inflatable body toward a flattened configuration when the first inflatable body is not bent.

2. The air couch bed as claimed in claim 1, wherein the second wall comprises an arch-like portion which defines the concave space.

3. The air couch bed as claimed in claim 2, wherein the tensioning element is connected to the second wall of the first inflatable body and extended over the concave space.

4. The air couch bed as claimed in claim 1, further comprising a second inflatable body disposed in the concave space wherein the first inflatable body is pushed to be bent by the second inflatable body when the second inflatable body is inflated.

5. The air couch bed as claimed in claim 4, wherein the tensioning element is connected to the second wall of the first inflatable body and extended over the concave space.

6. The air couch bed as claimed in claim 4, wherein the tensioning element is connected to the second wall of the first inflatable body;

wherein the tensioning element is in tension when the second inflatable body is inflated to bend the first inflatable body;

wherein the first inflatable body is flattened by the tensioning element when the second inflatable body is deflated.

7. The air couch bed as claimed in claim 6, wherein the tensioning element is an elastic cord.

8. The air couch bed as claimed in claim 1, wherein the tensioning element is configured to keep the first inflatable body bent when the first inflatable body is an air couch.

9. The air couch bed as claimed in claim 8, wherein the tensioning element is connected to the third wall.

10. The air couch bed as claimed in claim 8, wherein the tensioning element is a buckle strap.

11. An air couch bed, comprising:

a first inflatable body comprising a first wall, a second wall disposed opposite to the first wall, and a third wall connecting the first wall and the second wall;

a second inflatable body;

a tensioning element;

wherein the second wall defines a concave space, by virtue of which the first inflatable body is bendable;

wherein the concave space is extended to the third wall;

wherein the second inflatable body is disposed in the concave space, such that the first inflatable body is pushed to be bent by the second inflatable body when the second inflatable body is inflated;

wherein the tensioning element is connected to the second wall at a location apart from the third wall and is extended over the concave space, such that the first inflatable body is flattened by the tensioning element when the second inflatable body is deflated;

wherein the tensioning element is configured to bias the first inflatable body toward a flattened configuration when the first inflatable body is not bent.

12. The air couch bed of claim 1, wherein the concave space has a curved or tapered profile configured to deform during bending of the first inflatable body.

13. The air couch bed of claim 1, further comprising a second inflatable body disposed in the concave space, wherein expansion of the second inflatable body modifies a volume of the concave space.

14. The air couch bed of claim 1, wherein the tensioning element is anchored at opposing regions adjacent to the concave space.

* * * * *